US005670303A

United States Patent [19]

Ridgway et al.

[11] Patent Number: 5,670,303

[45] Date of Patent: Sep. 23, 1997

[54] METHOD AND APPARATUS FOR ALTERING THE PH OF A PHOTOGRAPHIC DEVELOPING SOLUTION

[75] Inventors: Michael Ridgway, Aldbury; Anthony Earle, Harrow Weald, both of England

[73] Assignee: Eastman Kodak Company, Rochester, N.Y.

[21] Appl. No.: 520,344

[22] Filed: Aug. 28, 1995

[30] Foreign Application Priority Data

Oct. 21, 1994 [GB] United Kingdom ..... 9421243

[51] Int. Cl.[6] ..... G03C 5/395

[52] U.S. Cl. ..... 430/399; 430/398; 430/434

[58] Field of Search ..... 430/398, 399, 430/434

[56] References Cited

U.S. PATENT DOCUMENTS

| | | | |
|---|---|---|---|
| 4,089,760 | 5/1978 | Ono | 430/399 |
| 4,145,271 | 3/1979 | Nosse et al. | 430/399 |
| 4,207,157 | 6/1980 | Hirai et al. | 430/399 |
| 4,217,188 | 8/1980 | Ono | 430/399 |
| 4,311,574 | 1/1982 | Ishikawa | 430/399 |
| 4,313,808 | 2/1982 | Idemoto et al. | 430/399 |

FOREIGN PATENT DOCUMENTS

| | | |
|---|---|---|
| 0 552 511 | 7/1993 | European Pat. Off. . |
| 1313796 | 4/1993 | United Kingdom . |

*Primary Examiner*—Hoa Van Le

*Attorney, Agent, or Firm*—J. Lanny Tucker

[57] ABSTRACT

A method for altering the pH of a photographic developing solution comprises altering the hydroxide ion concentration of the solution electrolytically. The method may be employed in photographic processing apparatus comprising a photographic development stage in which a photographic material to be processed is treated with a photographic developing solution wherein the apparatus comprises means for electrolytically altering the hydroxide ion concentration of the developing solution and means for controlling the operation of electrolytically altering the hydroxide ion concentration based on the change of hydroxide ion concentration in use.

10 Claims, 4 Drawing Sheets

METHOD AND APPARATUS FOR ALTERING THE PH OF A PHOTOGRAPHIC DEVELOPING SOLUTION

FIELD OF THE INVENTION

The invention relates to a method and apparatus for altering the pH of a photographic developing solution. The invention is of particular use in the development of an exposed radiation-sensitive silver halide material.

BACKGROUND OF THE INVENTION

A large number of photographic developing agents are known. Examples of such developing agents include hydroquinone, p-phenylenediamine and ascorbic acid.

To be most effective, a solution of a developing agent should have a certain pH. For example, the organic developing agents require an alkaline environment to be effective. The strength of the alkali will depend upon the nature of the developing agent and the activity required.

In addition, the buffering action of the alkali, i.e. the reserve of alkali available to neutralise the hydrogen ions formed during development, is important.

As such a developer is used, the concentration of the developing agent decreases and the alkalinity decreases. These and other changes contribute to a reduction in the activity of the developer. This effect can be overcome by adding one or more replenishing solutions. For example, the addition of alkali can restore the original pH.

The activity of the developer can also be reduced by aerial oxidation. It is common practice to incorporate sulphite in the developer as an antioxidant.

EP-0 552 511 describes a method for controlling the pH of an ascorbic acid type developer. The pH of the developing solution is maintained during use by the automatic addition of an appropriate amount of alkali. The amount is controlled by a redox potential measuring system which monitors the pH of the developer.

PROBLEM TO BE SOLVED BY THE INVENTION

A method of altering the pH of a developer without having to add a separate solution is desirable.

Some developers e.g. those used for graphic arts materials require high pH under very good control. It is not possible to obtain adequate buffering with carbonates at the pH required and phosphates are undesirable for several reasons. Consequently, there is a need for a method which avoids the complexities of buffering high pH values.

Developers are often sold as concentrates which require high concentrations of base and buffer. While high concentrations of base and buffer are inherently undesirable, they exacerbate the problem of the solubility of the sulphite commonly employed. There is a need for avoiding such high concentrations without having to add a separate solution before use.

A way of reducing the tendency of a developer to oxidise in the air which diminishes or eliminates the need for an antioxidant such as sulphite is desirable.

SUMMARY OF THE INVENTION

The invention provides a method for altering the pH of a photographic developing solution by altering the hydroxide ion concentration of the solution characterised in that the hydroxide ion concentration is altered electrolytically.

Photographic processing apparatus comprises a photographic development stage in which a photographic material to be processed is treated with a photographic developer solution characterised in that the apparatus comprises means for electrolytically altering the hydroxide ion concentration of the developer solution and means for controlling the operation of electrolytically altering the hydroxide ion concentration based on the change of hydroxide ion concentration in use.

A method for developing an exposed radiation-sensitive silver halide material using a photographic developing solution wherein the pH of the solution is altered to a desired value by altering the hydroxide ion concentration of the solution is characterised in that the pH of the solution is altered electrolytically.

ADVANTAGEOUS EFFECT OF THE INVENTION

The pH of the developer can be altered without having to add a separate solution.

The complexities of buffering high pH values can be avoided by generating base in the developer when needed.

The ability to generate base on demand makes it possible to reduce the amount of base and buffer contained in developer concentrates. A reduction in the amount of base and buffer contained in developer concentrates increases the solubility of sulphite in the concentrates. Also, the generation of base in this way avoids the sale and handling of concentrated hydroxide solutions.

Some developing agents e.g. ascorbic acid oxidise in the air to give lower pH. Electrical generation of base on a time dependent basis helps to make such developers practical.

BRIEF DESCRIPTION OF THE DRAWINGS

For a better understanding of the present invention, reference will now be made, byway of example only, to the accompanying drawings in which.

DETAILED DESCRIPTION OF THE INVENTION

Figure 1:
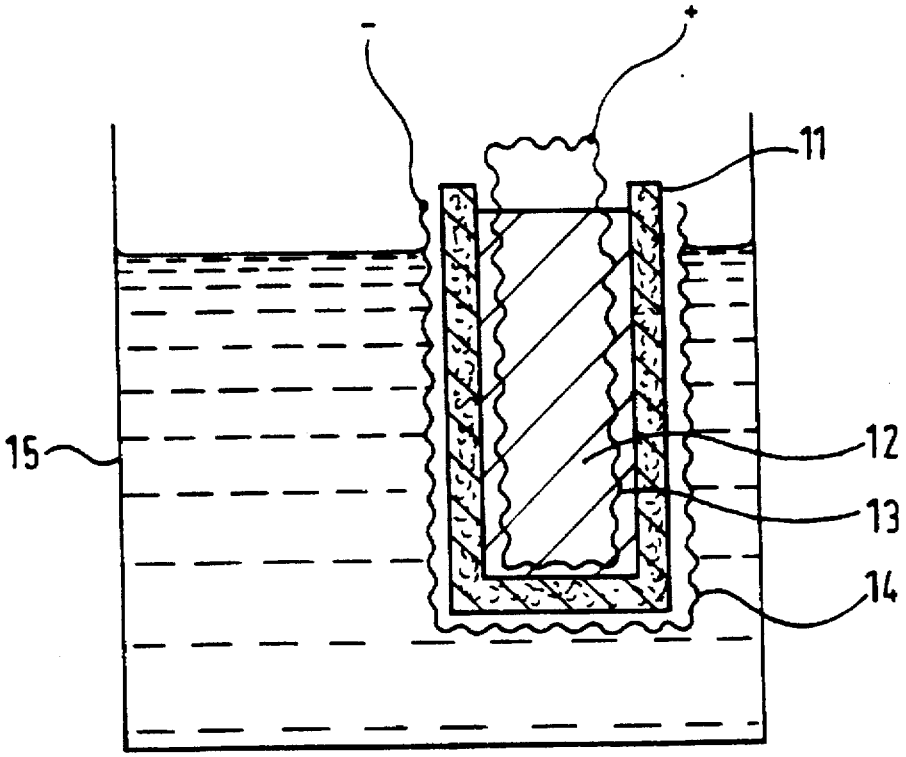
FIG. 1 is a schematic representation of an electrolytic cell useful in the invention.

The hydroxide ion concentration of the photographic developer solution may be altered electrolytically by contacting the solution with an electrolytic cell comprising an electrode in contact with the developing solution and an electrode in contact with a slurry of sparingly soluble salt capable of acting as a pH buffer which is separated from the developing solution by an ion-permeable barrier and passing an electric current through the cell.

The potential difference applied to the electrodes may range from 0.5 to 50 V, preferably from 2 to 10 V.

The current passing between the electrodes may range from 0.005 to 100 A, preferably from 0.02 to 10A.

The electrode in contact with the developer solution may be made of any suitable electroconductive material e.g. a metal such as steel including stainless steel, platinum, gold and titanium; or other materials such as carbon and silicon carbide. The electrode may take a variety of forms e.g. steel wool or steel mesh.

The electrode in contact with the slurry of sparingly soluble salt may be made of any suitable electroconductive material e.g. a metal such as steel including stainless steel, platinum, gold and titanium; or other materials such as carbon and silicon carbide. The electrode may take a variety of forms e.g. steel wool or steel mesh.

The slurry of sparingly soluble salt may comprise one or more basic salts. Examples of suitable salts include calcium carbonate, calcium bicarbonate, calcium hydroxide, magnesium carbonate, magnesium bicarbonate, magnesium hydroxide, zinc carbonate, zinc bicarbonate and zinc hydroxide.

The ion-permeable barrier separating the slurry of sparingly soluble salt from the developer solution may be a liquid bridge, a membrane or a porous barrier. Although easy mixing of the slurry and developer should be avoided, some limited mixing is not deleterious. Examples of suitable ionpermeable barrier materials include osmosis membranes, dialysis membranes and ionomers e.g. NAFION (Du Pont).

The developer solution comprises any suitable developing agent. Examples of such developing agents are disclosed in *Research Disclosure*, December 1989, Item 308119, Section XX, published by Kenneth Mason Publications, Ltd., Dudley Annex, 12*a* North Street, Emsworth, Hampshire PO10 7DQ, England.

Developers such as hydroquinone tend to increase their pH on standing. This effect can be overcome by making the pH of the slurry lower than the working pH. The action of the buffer acting through the membrane counteracts the effect.

The electrolytic cell can be used to raise the hydroxide ion concentration of the developer solution by making the electrode in contact with the developer solution the cathode. The current passing through the cell generates hydroxide ion at the cathode and hydrogen ion at the anode. The hydrogen ion is generated in the immediate proximity of a large quantity of base which will prevent the pH being lowered by this ion later.

The base is in effect transferred from the slurry to the developer electrically in an amount which is proportional to the current and length of time for which the current is applied. The amount to be transferred can be determined by the usual techniques of time and/or workload, or by pH measurement, or by analysis.

A current may be passed through the cell as the developer is used so that hydroxide ion is generated to replace that used in development. If the pH of the developer solution is too low to use immediately then the hydroxide can be generated before use.

If the pH of the buffer is below the working pH of the developer, the pH of the developer can be lowered by turning the cell off and can be raised by turning it on. If the pH of the buffer is below the pH at which the developer is active, the pH of the developer will drop to below its active pH when the cell is turned off thus preserving it against aerial oxidation when not in use. The developer can then be re-activated by turning the cell on to raise the pH before it can be used again. This enables developer to be supplied in inactive or less active form to be activated by the cell.

Alternatively, the electrolytic cell can be used to lower the hydroxide ion concentration of the developer solution by making the electrode in contact with the developer solution the anode. Under these conditions, developer would normally be oxidised at the anode. For example, it might be desirable to lower the pH of the developer solution in this way at the end of its working life to facilitate disposal.

The invention is of use in any photographic processing apparatus comprising a photographic development stage in which a photographic material to be processed is treated with a photographic developer solution. The photographic material may be a light sensitive photographic film or paper. For example, many conventional photographic processors comprise a plurality of tanks containing various processing fluids, each tank having a plurality of rollers for transporting the light-sensitive material therethrough. Pumps may be used to circulate the processing fluids within the processor tanks.

In addition to the features of known processing apparatus, the invention provides means for electrolytically altering the hydroxide ion concentration of the developer solution and means for controlling the operation of electrolytically altering the hydroxide ion concentration based on the change of hydroxide ion concentration in use.

The means for electrolytically altering the hydroxide ion concentration of the solution may comprise an electrolytic cell comprising an electrode for contacting the developing solution and an electrode in contact with a slurry of sparingly soluble basic salt which is separated from the electrode for contacting the developing solution by an ion-permeable barrier.

The means for controlling the operation of electrolytically altering the hydroxide ion concentration based on the change of hydroxide ion concentration in use may take a variety of forms. For example, the control means may comprise means for operating the electrolytic cell so that the current passed through the cell and the length of time for which the current is passed is sufficient to Generate a desired amount of hydroxide ions in the developer solution.

The desired amount of hydroxide ions may be that sufficient to maintain the pH of the developer solution at a constant value.

In one embodiment, the amount of hydroxide ions to be generated may be calculated according to the workload of the processor i.e. from a knowledge of the quantity of photographic material to be processed in a given time, the amount of hydroxide ion depletion can be calculated and the amount of electrolysis required to offset the depletion can be determined. The control means ensures that an appropriate current is passed through the electrolytic cell for an appropriate length of time.

In an alternative embodiment, the means for controlling the operation of electrolytically altering the hydroxide ion concentration comprises means for measuring the hydroxide ion concentration or pH of the developing solution e.g. a redox electrode system. The amount of electrolysis required is based on the measurement provided by the measurement system. For example, a control arrangement can be provided which is capable of producing an output pulse whose duration varies depending on the difference in potential between a reference potential and the potential measured by the redox electrode system, whereby said output pulse is used to operate a relay device controlling the operation of passing an electric current through the electrolytic cell.

The electrolytic cell can be built into a cartridge pack with a connection device for coupling to a photographic processor. An example of such a cartridge pack is described in EP-A-0 608 947.

The electrolytic cell can be in the form of a separate container e.g. a tube, and can have pH electrodes built in. The container can be a plug-in disposable item avoiding the need to calibrate the electrodes or to replace the slurry. The electrolytic cell can include an ion exchange resin in the developer path to replace calcium ions with a more soluble ion such as sodium.

The invention is further illustrated by way of example with reference to the accompanying drawings.

FIG. 1 is a schematic representation of an electrolytic cell useful in the invention. The cell comprises a papier mache cup 11 which is loosely filled with calcium carbonate 12. An electrode of stainless steel cloth 13 is inserted in the calcium carbonate. Another stainless steel cloth electrode 14 is wrapped around the cup. The cell is immersed in a container of developer solution 15. The electrodes are connected to a power source (not shown) so that electrode 13 is the anode and electrode 14 is the cathode.

Figure 2:
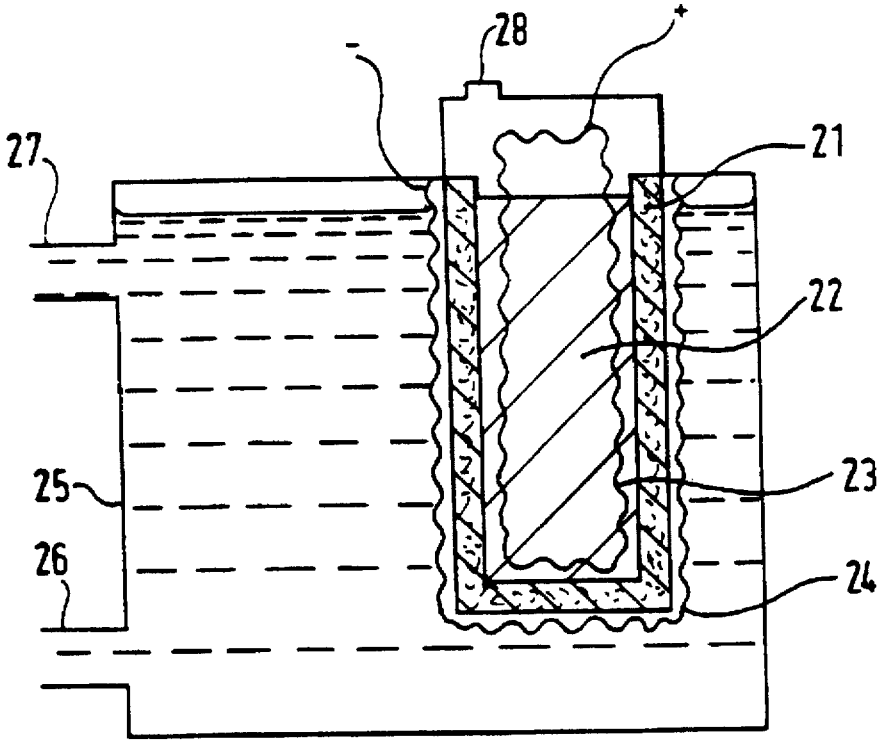
FIG. 2 is a schematic representation of another electrolytic cell useful in the invention.

FIG. 2 is a schematic representation of another electrolytic cell useful in the invention. FIG. 2 shows a modification of the cell described in FIG. 1 intended for inclusion in a recirculation system. The cell comprises a papier mache cup 21 which is loosely filled with calcium carbonate 22. An electrode of stainless steel cloth 23 is inserted in the calcium carbonate. Another stainless steel cloth electrode 24 is wrapped around the cup. The cell is immersed in a container of developer solution 25. The electrodes are connected to a power source (not shown) so that electrode 23 is the anode and electrode 24 is the cathode. The container 25 is closed and is provided with an inlet 26 and outlet 27 to allow recirculated solutions to be pumped through. The inner container of the electrode system is also closed but has a gas vent valve 28 to relieve the pressure which builds up as gas is generated.

Figure 3:
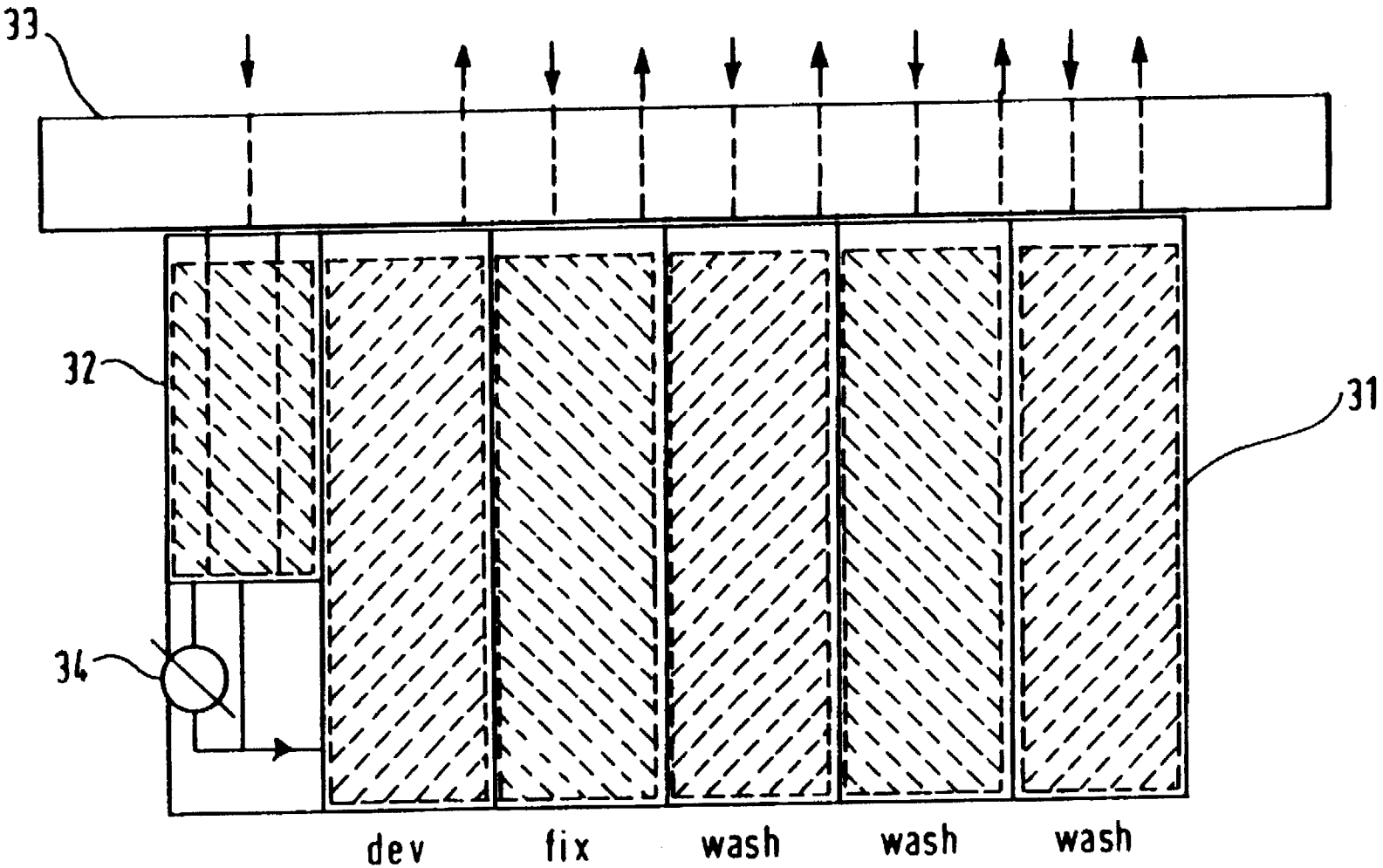
FIG. 3 is a schematic representation of photographic processing apparatus incorporating an electrolytic cell useful in the invention.

FIG. 3 is a schematic representation of photographic processing apparatus incorporating an electrolytic cell useful in the invention. The electrolytic cell 32 forms part of a chemical supply cartridge 31 for supplying processing solutions to a photographic processor (not shown). The cartridge 31 is coupled to the photographic processor through a connection device 33. In addition to the electrolytic cell 32, the cartridge comprises a compartment containing developer solution, a compartment containing fixer solution and three separate compartments containing wash solution as shown.

The direction of flow of the various solutions to and from the photographic processor is indicated by the arrows. In operation, used developer solution flows from the photographic processor into the electrolytic cell 32 where the pH of the solution is adjusted in accordance with the invention. The developer solution then flows into the compartment containing developer solution from which it can be returned to the processor.

At the end of the working life of the chemistry, a tap 34 or suitable device is opened as the cartridge is removed which allows the high pH developer to mix with the low pH contents of the inner container of the electrolytic cell 31. Thus the pH is reduced for return to the factory or disposal. Alternatively, the pH may be reduced by reversing the current passed through the cell.

Figure 4:
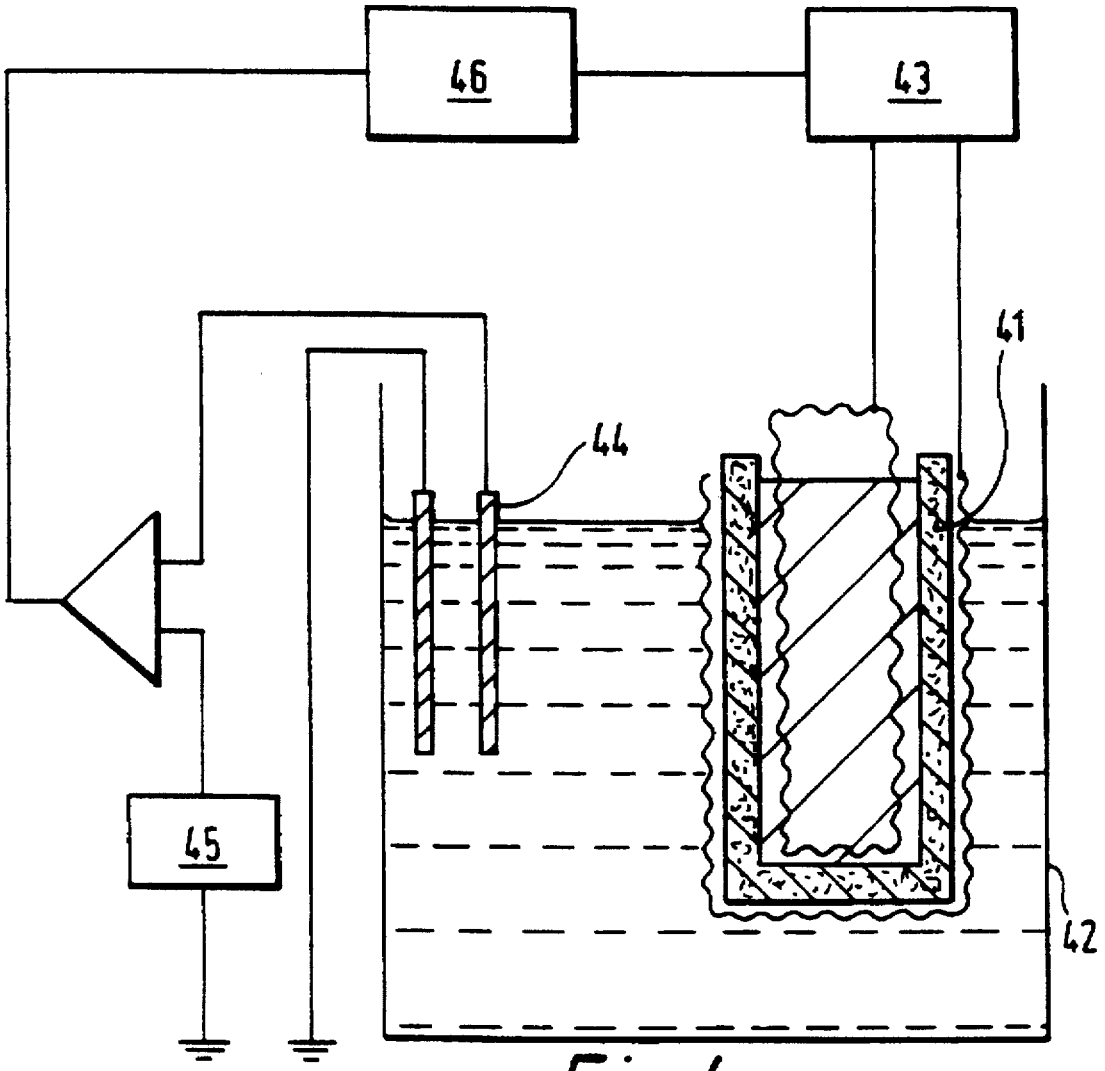
FIG. 4 is a schematic representation of apparatus in accordance with the invention.

FIG. 4 is a schematic representation of apparatus in accordance with the invention. An electrolytic cell 41 of the type shown in FIG. 1 is immersed in a container of developer solution 42. The electrodes of the electrolytic cell are connected to a power source 43. A redox electrode system 44 for producing a signal dependent on the state of oxidation of the developer solution is immersed in the container of developer solution 42. The redox electrode pH measuring system 44 may comprise a carbon electrode/calomel reference electrode. The value of the signal from the measuring system 44 is compared with a reference signal generated by a timing pulse generator 45 which produces a timing pulse corresponding to the difference between the signals. The timing pulse is employed to actuate a relay unit 46 to control the operation of the electrolytic cell 41. The timing pulse controls the passage of electrical current through the electrolytic cell 41 until the difference signal is reduced to zero.

Figure 5:
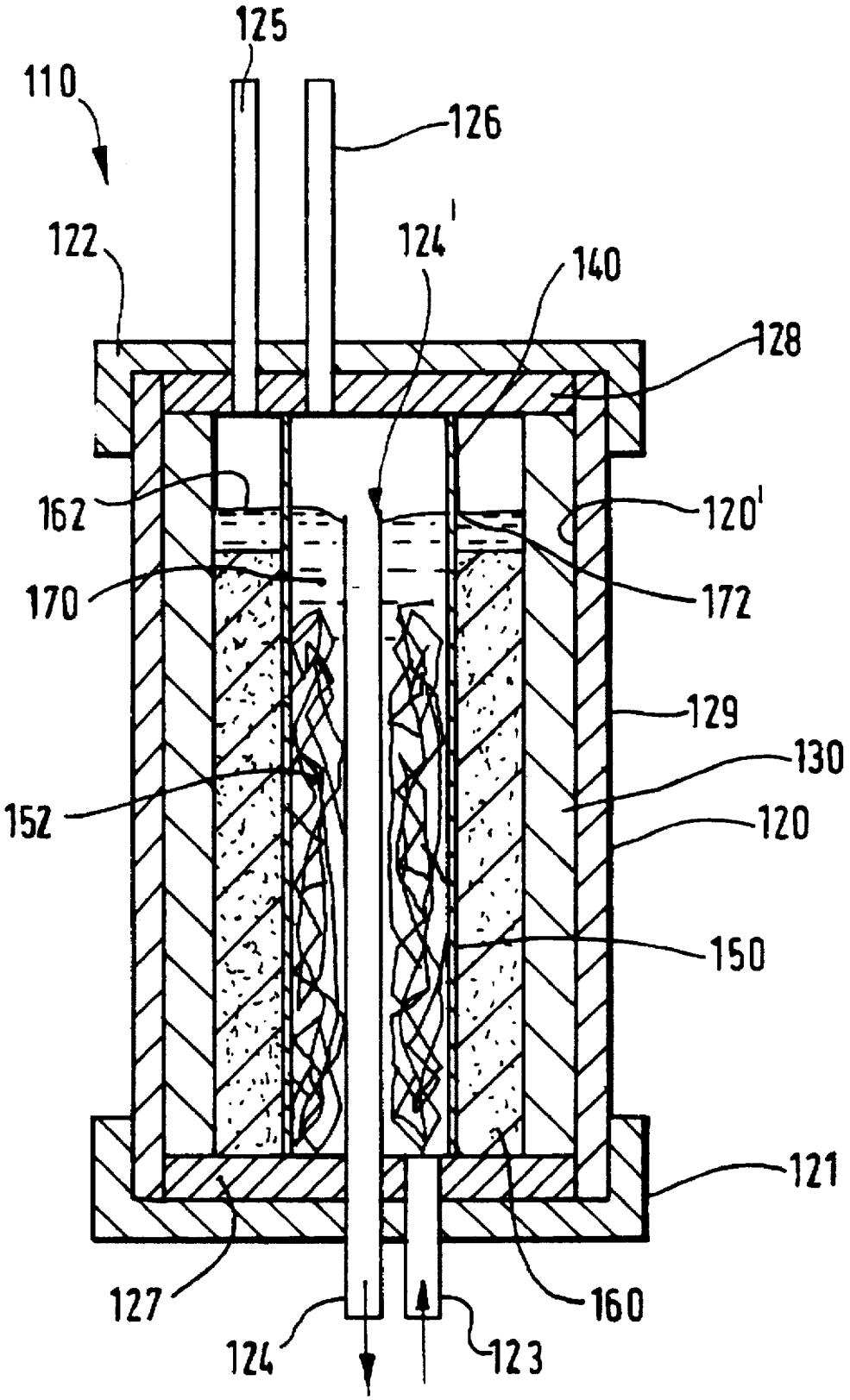
FIG. 5 is a schematic representation of a further electrolytic cell useful in the invention.

FIG. 5 is a schematic representation of a further electrolytic cell useful in the invention. An improved electrolytic cell 110 comprises a cylindrical outer case 120, an annular anode 130, an ion-permeable barrier 140 and a cathode 150. Slurry 160 is retained between the ion-permeable barrier and the anode 130. Developer solution 170 is retained inside the ion-permeable barrier 140.

The outer case 120 has a lower end cap 121 and an upper end cap 122. End caps 121, 122 may be fixed to the outer case 120 in any convenient manner. However, it is preferred that the outer case 120 has screw threads formed adjacent its ends (not shown) to provide a screw engagement for the end caps 121, 122.

Lower end cap 121 has an inlet tube 123 and an outlet tube 124 formed therein. Outlet tube 124 is located centrally with respect to the outer case 120. Upper end cap 122 has vents 125, 126 formed therein. Respective seals 127, 128 are provided between lower and upper end caps 121, 122 and the anode 130 and ion-permeable barrier 140.

Electrical connection to anode 130 is made by one or more circlips (not shown) which are located in circumferential wall surface 129 of case 120. As electrical connection to the anode 130 is not immersed in developer solution, it cannot be easily corroded.

Electrical connection to cathode 150 is made via outlet tube 124 (not shown).

Naturally, lower seal 127 seals around inlet and outlet tubes 123, 124 and upper seal 128 seals around vents 125, 126.

Ion-permeable barrier 140 comprises a cylindrical support member which is located centrally inside outer case 120. The support member is covered with a filtration medium (not shown) which allows ions to migrate between developer solution 170 and slurry 160 without allowing particles of the slurry 160 to enter the developer solution 170. The support member may comprise a spring, a tube of steel mesh or similar material. The filtration medium may comprise filter paper, or a suitable plastic or metal equivalent material. The ion-permeable barrier 140 may be convoluted to increase the working surface area.

Anode 130, made of carbon, is positioned between the ion-permeable barrier 140 and the outer case 120, lying adjacent inner surface 120' thereof.

Cathode 150 is formed from steel wool and defines a cathodic region 152 positioned inside ion-permeable barrier 140 and surrounding inlet tube 123. Inlet tube 123 extends into the cathodic region 152.

Slurry 160 is retained in the cell 110 between ion-permeable barrier 140 and carbon anode 130. Initially, the slurry 160 may be introduced into the cell 110 as a dry powder of calcium carbonate, calcium hydroxide or similar material. When developer solution is pumped into the cell 110 via inlet 123, some of the solution will penetrate the ion-permeable barrier 140 and provide the liquid for the slurry 160.

In large electrolytic cells, it may be advantageous to provide circulation for the slurry (not shown). Alternatively, the cell can be filled with prepared slurry prior to use. It will be appreciated that oxygen gas produced during use will provide some circulation, and will be discharged at surface 162 and be vented via vent 125.

When the electrolytic cell of the present invention is in use, developer solution is pumped in through inlet 123 through the cathodic region 152 and steel wool cathode 150 to the top 124' of outlet tube 124. The outlet tube 124 forms a constant head which avoids the risk of changing hydrostatic head causing undue mixing of the liquid in the slurry 160 with the developer solution. Naturally, the liquid in the slurry 160 will contain oxidised developer solution.

Bubbles of hydrogen produced in the developer solution during the electrolytic reaction are carried upwards to the surface 172 of the developer solution 170 where they are discharged and can be vented out of the cell 110 through vent 126.

Although two vents 125, 126 are shown for oxygen and hydrogen respectively, a sufficiently large single vent (not shown) may be provided in upper end cap 122 to provide adequate ventilation for the cell 110 thereby preventing ignition of the gases.

Alternatively, the hydrogen produced can be oxidised in a controlled way using a catalytic oxidising system.

The electrolytic cell of the present invention can also be used to prevent or reduce aerial oxidation of developer solution in a processing machine. The voltage required to achieve these results is lower than that required to generate hydroxide ions and so no build up of hydroxide ions results.

The invention is illustrated by way of example as follows.

EXAMPLE

An electrolytic cell as shown in FIG. 1 was prepared. A Soxlet extraction thimble (a papier mache cup) 11 is loosely filled with calcium carbonate 12 and an electrode of stainless steel cloth is inserted in the carbonate 12. A stainless steel cloth cathode 13 is wrapped round the thimble and the whole lowered into a beaker of the desired liquid 15. The thimble can with advantage be filled with water before the insertion. A current of about 1A is passed through the cell at from 4 to 12 V depending on conditions.

TABLE 1

| pH of water after contact with the cell | | |
|---|---|---|
| Time (min) | Cell 1 | Cell 2 |
| 1 | 9.0 | 9.2 |
| 2 | 10.0 | 9.6 |
| 3 | 10.2 | 9.9 |
| 4 | | 10.2 |
| 7 | 11.3 | |
| 8 | | 11.6 |
| 9 | 11.7 | |
| 13 | | 12.3 |
| 16 | 12.6 | |
| 19 | | 12.6 |
| 26 | 12.9 | |
| 43 | 13.0 | |
| 56 | | 13.0 |
| 72 | 13.5 | |

Tap water was used as the solution in Cell 1. The pH of the calcium carbonate slurry was about 7.0.

Cell 2 represents a modification of Cell 1 in which tap water was used as the solution and the calcium carbonate was replaced with calcium hydroxide. The pH of the slurry was about 13.0.

In a further experiment the solution outside Cell 1 was standard "Ektacolor" developer (rep.) i.e. a p-phenylenediamine developer, to which had been added 10 ml of approx. Normal sulphuric acid; consequently both pH and activity were reduced.

Electrolysis for 85 minutes restored both pH and activity to original values.

In a further experiment the solution was standard 2000 series developer (Photocomposition developer based on hydroquinone) that had been made up without the carbonate buffer and adjusted to pH 9 with potassium hydroxide. A time series showed that the pH and activity increased with the time spent electrolysing the cell until the full activity of the standard developer was obtained.

In a further experiment the liquid was an experimental ascorbic acid developer designed for composition emulsions. The pH and activity again increased with time in contact with the cell, giving a satisfactory activity at the expected pH.

The invention has been described in detail, with particular reference to certain preferred embodiments thereof, but it should be understood that variations and modifications can be effected within the spirit and scope of the invention.

We claim:

1. A method for processing comprising:

developing an imagewise exposed radiation-sensitive silver halide material in a photographic developing solution, said developing solution being contained in a processing apparatus that comprises a means for electrolytically altering the hydrogen ion concentration of said developing solution, and a means for controlling the operation of said electrolytically altering of the hydrogen ion concentration based on the change in hydrogen ion concentration in said developing solution during processing, wherein said hydrogen ion concentration altering means comprises an electrolytic cell comprising an electrode in contact with said developing solution and an electrode in contact with a slurry of a sparingly soluble salt capable of acting as a pH buffer that is separated from said developing solution by an ion-permeable barrier.

2. The method of claim 1 wherein said electrode in contact with said developing solution is the cathode of said cell.

3. The method of claim 1 wherein said electrolytic cell comprises an outer case in which an anode and a cathode are positioned, the outer case having an inlet, an outlet and at least one vent for venting gases produced during electrolysis, the anode comprising an annular carbon electrode and the cathode comprising steel.

4. The method of claim 1 wherein said controlling means comprises means for measuring the hydroxide ion concentration or pH of said developing solution.

5. The method of claim 4 wherein said measuring means is a redox electrode system.

6. The method of claim 1 wherein the potential difference applied to said electrodes is from 2 to 10 volts and the current passing between said electrodes is from 0.02 to 10 amperes.

7. The method of claim 1 wherein said processing apparatus comprises a cartridge pack containing said developing solution and said electrolytically altering means.

8. A method for developing an exposed radiation-sensitive silver halide material comprising:

contacting said exposed radiation-sensitive silver halide material with a photographic developing solution wherein the pH of said solution is altered during processing to a desired value electrolytically, said pH altering being carried out by contacting said solution with an electrolytic cell comprising an electrode in contact with said solution and an electrode in contact with a slurry of sparingly soluble salt capable of acting as a pH buffer which is separated from said solution by an ion-permeable barrier, and passing an electric current through said cell.

9. The method of claim 8, wherein the electrode in contact with the developing solution is the cathode.

10. The method of claim 8, wherein the alkalinity of the developing solution is maintained at a desired level by measuring the hydroxide ion concentration or pH of the developing solution and altering the hydroxide ion concentration on the basis of said measurement.

* * * * *